United States Patent [19]

Larriva

[11] 4,069,687

[45] Jan. 24, 1978

[54] REFRIGERATION EVAPORATIVE BOOSTER COMBINATION

[76] Inventor: Raoul M. Larriva, 5020 E. First St., Tucson, Ariz. 85711

[21] Appl. No.: 744,282

[22] Filed: Nov. 22, 1976

[51] Int. Cl.[2] ..... F28D 5/00; F25D 17/06

[52] U.S. Cl. ..... 62/305; 62/310; 62/428

[58] Field of Search ..... 62/305, 310, 428

[56] References Cited

U.S. PATENT DOCUMENTS

| | | | |
|---|---|---|---|
| 2,166,158 | 7/1939 | Kalischer | 62/305 |
| 2,493,141 | 1/1950 | Henney | 62/305 |
| 2,566,366 | 9/1951 | Pennington | 62/310 |
| 3,026,690 | 3/1962 | Deverall | 62/305 |
| 3,313,120 | 4/1967 | Kuss et al. | 62/305 |
| 3,365,909 | 1/1968 | Brainard | 62/305 |

FOREIGN PATENT DOCUMENTS

| | | | |
|---|---|---|---|
| 845,844 | 8/1960 | United Kingdom | 62/305 |

*Primary Examiner*—Lloyd L. King
*Attorney, Agent, or Firm*—James A. Eyster

[57] ABSTRACT

A compressor type air cooler is combined with a booster comprising an evaporative air precooler, a refrigerant vapor precooler and a refrigerant liquid cooler. This makes the compressor type cooler usable in localities where the ambient temperature is so high as to prohibit use of the compressor type cooler alone, and saves a notable amount of electrical power at any ambient temperature.

4 Claims, 1 Drawing Figure

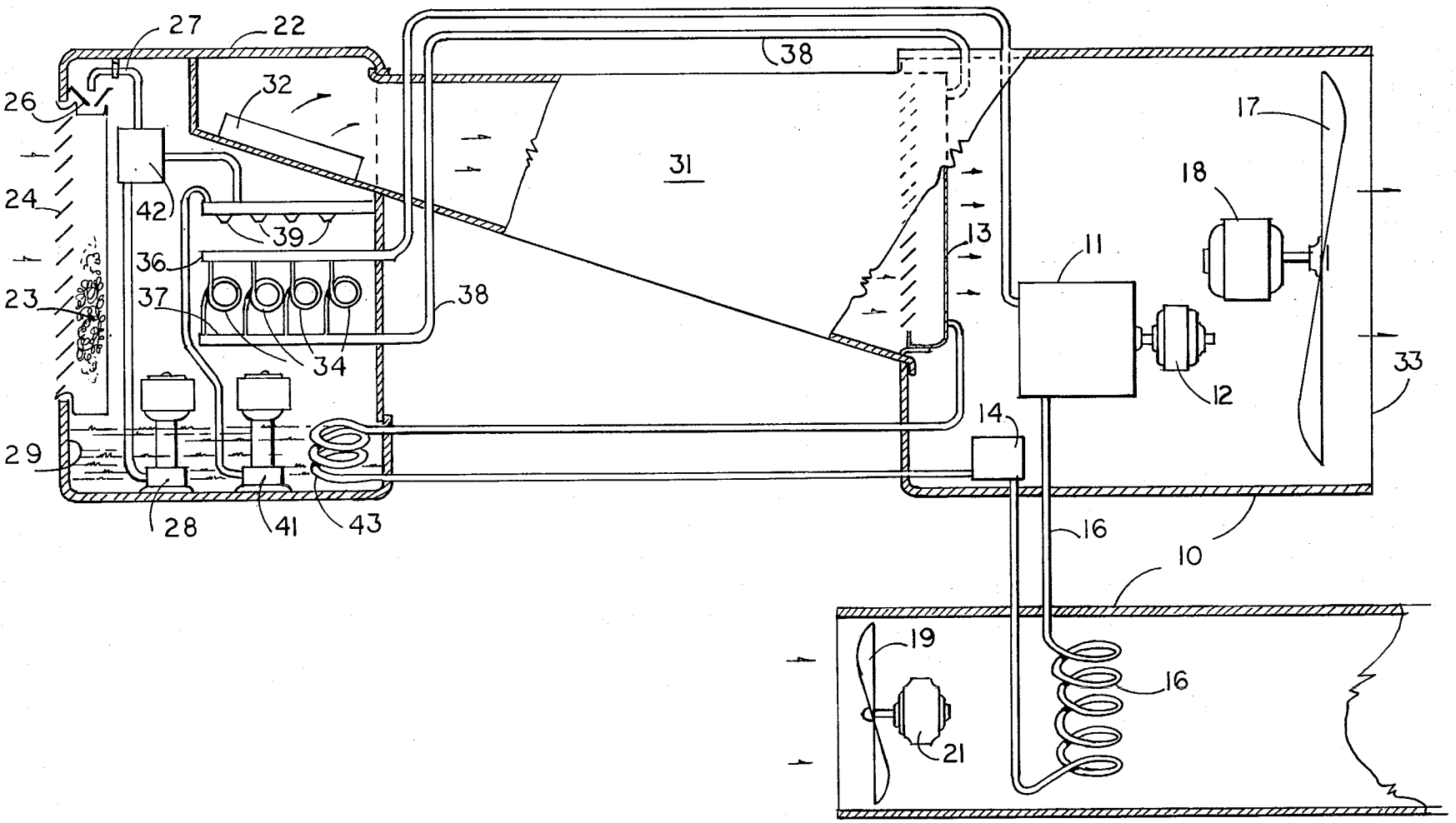
33
17
18
12
10
16
11
16
14
13
21
19
38
31
38
43
34
22
32
39
41
27
42
36
37
28
26
24
23
29

REFRIGERATION EVAPORATIVE BOOSTER COMBINATION

BACKGROUND OF THE INVENTION

This invention relates to mechanical compression-type refrigerating units for all purposes and in all sizes, including high, medium and low back-pressure types.

Compressor-type refrigerating units are usually designed to operate in ambient temperatures not higher than 95° F. (35° C.), which is satisfactory in 94% of the area of the lower Continental United States. However, in the South and Southwest summer temperatures often are higher than 95° F. and sometimes are much higher. Although refrigerating units are useful for cooling buildings, particularly when the ambient humidity is high, they are expensive to operate because the cost of the electrical energy is relatively great.

SUMMARY OF THE INVENTION

This invention provides an auxiliary unit for use with any compressor-type refrigerating unit which enables use in any ambient temperature and, moreover, greatly reduces consumption of electricity by the combined units below that of the refrigerating unit when used alone.

The auxiliary unit performs three functions; it precools the air to the condenser of the refrigerating unit; it precools the refrigerant gas entering the condenser; and it precools the refrigerant liquid leaving the condenser before it enters the expansion valve.

To accomplish these functions the auxiliary unit comprises a complete evaporative-type cooler except that the air impeller is omitted. The evaporative cooler case also encloses a pipe coil carrying refrigerant vapor and cooled by a water spray. Finally, the evaporative cooler water pan contains a second pipe coil carrying refrigerant liquid.

In parts of the country having low humidity and elevated summer temperatures, as in the Great Sonoran Desert, the use of this evaporative booster makes the compression-type refrigerative unit usable although unusable without it. In any ambient temperature a marked saving in electrical energy will be realized.

One object of this invention is to provide an evaporative booster unit for use as an auxiliary to a compressor-type refrigeration unit.

Another object of this invention is to provide a refrigeration unit comprising, in combination, a compressor-type element and an evaporative-type element.

BRIEF DESCRIPTION OF THE DRAWING

A schematic drawing, partly in section, of the refrigeration evaporative booster.

DESCRIPTION OF THE PREFERRED EMBODIMENT

Referring to the drawing, a compressor-type refrigerating unit 10 for use in cooling a moderate-sized dwelling is employed as an example. It consists of the following conventional principal parts: a compressor 11 operated by an electric motor 12, a condenser 13, an expansion valve 14, and a cooling coil 16. Also required are an air impeller 17 for drawing cooling air through the condenser 13, with motor 18; and an air blower 19 with motor 21 for blowing air through the cooling coil 16 and thence through the house cooling air ducts.

Electrical power connections are omitted from the motors for clarity.

Conventionally, hot compressed refrigerant vapor is piped from the compressor 11 to one end of the condenser 13 and cool refrigerant liquid is piped from the other end of the condenser 13 to the expansion valve 14. From valve 14 the expanded cold refrigerant vapor is passed through coil 16 and back to the compressor 11.

In this invention the cooling air applied to the condenser 13 is precooled by an evaporative cooler unit 22. This unit is provided with at least one pad 23, usually made of excelsior. The pad is protected by louvers 24 and kept moist by water dripped on it from a trough 26 fed by a pipe 27. Water is supplied to the pipe 27 by a small electric pump 28 immersed in a water pan 29 in the bottom of the cooler. The pan 29 is kept supplied with make-up water by means of a float valve, not shown. Cooler 22 is connected to unit 10 by a duct 31 in such a way that the air impeller 17 draws air through louvers 24 and moist pad 23, an air filter 32, duct 31 and condenser 13. The air is finally discharged to the atmosphere from the exit opening 33.

The hot refrigerant vapor output of compressor 11, instead of being piped directly to the condenser, is first passed through coils 34 suspended in air in the evaporative cooler case. These coils 34 consist of a number of copper coils or pipe units connected in parallel between a feed header 36 and an output header 37. The parallel connection is employed to reduce back pressure. From the output header 37 the vapor is piped to the condenser through pipe 38. The paralleled coils 34 are cooled by water spray from nozzles 39 fed by a second water pump 41 which picks up water from pan 29.

In this embodiment it is found that the water requirement of spray nozzles 39 is greater than the requirement of cooling pad 23, so that it is desirable to divert a part of the output of pump 28 by a fractionating valve 42 to the spray nozzles 39. Two small electric pumps, 1/40 or 1/60 horsepower, widely used in evaporative coolers, are preferably rather than much more expensive, larger pumps.

A cooling pipe coil 43 is immersed in the water contained in pan 29 and is connected between the outflow terminal of condenser 13 and the input terminal of expansion valve 14.

In operation, all motors being turned on, air is drawn through pad 23, where it is cooled by evaporation, perhaps to 25° F. below the ambient temperature when the humidity is low. This cool, moist air is filtered at 32 and supplied to cool the refrigerant in condenser 13, changing the refrigerant from vapor to liquid. The hot vapor from compressor 11 is precooled by coils 34 before entering the condenser, and the liquid refrigerant output of the condenser is further cooled in coil 43 before entering the expansion valve 14.

I claim:

1. A refrigerative evaporative booster combination comprising:

a refrigerative air cooler containing a fluid refrigerant and a condenser, said condenser containing a refrigerant pipe unit having a pipe input and a pipe output;

a condenser fan passing air through said condenser;

an evaporative air cooler containing at least one water-dampened cooler pad, containing a water-cooled pipe unit and containing a sump collecting excess water from said at least one pad and from the water-cooled pipe unit;

pipes containing a refrigerant, said pipes interconnecting said refrigerative air cooler and said evaporative air cooler; and air duct means interconnecting said refrigerative air cooler and said evaporative air cooler whereby air moved by said condenser fan passes successively through said at least one cooler pad and said condenser.

2. A combination in accordance with claim 1 comprising:

refrigerant pipes connecting said condenser input to said water-cooled pipe unit whereby said refrigerant is precooled before entering the condenser;

a pipe element water-immersed in said sump; and refrigerant pipes connecting said pipe output and said pipe element whereby said refrigerant is post-cooled after leaving the condenser.

3. A combination in accordance with claim 2 comprising:

a refrigerative air cooler comprising in addition a compressor, an expansion valve, a cooling coil with a fan, and refrigerant pipes connecting all refrigerative air cooler elements in series; and an evaporative air cooler comprising in addition means pumping water from said sump to a trough above each said cooler pad and also to means above said pipe unit to water cool it; means supplying make-up water to said sump, valve means maintaining a selected water level in said sump, a refrigerant pipe connected to the output of said compressor and the input of said water-cooled pipe unit, a refigerant pipe connected to the output of said water-cooled pipe unit and the input of said condenser, a refrigerant pipe connected to the output of said condenser and the input of said pipe element, and a refrigerant pipe connected to the output of said pipe element and the input of said expansion valve.

4. A combination in accordance with claim 3 comprising in addition in said refrigerative air cooler:

a fractionating valve dividing the sump water pumped by said means to the trough above said cooler pad and the sump water pumped by said means above said pipe unit; and an air filter interposed in the duct carrying the air stream leaving said cooler pad and directed toward said condenser.

* * * * *